US006928971B2

(12) United States Patent
Knecht et al.

(10) Patent No.: US 6,928,971 B2
(45) Date of Patent: Aug. 16, 2005

(54) CAMSHAFT ADJUSTING DEVICE FOR INTERNAL COMBUSTION ENGINES OF MOTOR VEHICLES

(75) Inventors: Andreas Knecht, Kusterdingen (DE); Ulf Polzin, Leinfelden-Echterdingen (DE)

(73) Assignee: Hydraulik-Ring GmbH, Marktheidenfeld (DE)

( * ) Notice: Subject to any disclaimer, the term of this patent is extended or adjusted under 35 U.S.C. 154(b) by 0 days.

(21) Appl. No.: 10/708,335

(22) Filed: Feb. 25, 2004

(65) Prior Publication Data

US 2004/0221826 A1 Nov. 11, 2004

(30) Foreign Application Priority Data

Feb. 26, 2003 (DE) ..... 103 08 072

(51) Int. Cl.[7] ..... F01L 1/34

(52) U.S. Cl. ..... 123/90.17; 123/90.18; 123/195 A; 123/90.15

(58) Field of Search ..... 123/90.15–90.18, 123/90.27, 90.31, 195 A

(56) References Cited

U.S. PATENT DOCUMENTS

| | | | | |
|---|---|---|---|---|
| 2,749,893 A | | 6/1956 | Porsche et al. | 123/90 |
| 3,110,195 A | | 11/1963 | Hanley | 74/604 |
| 4,610,224 A | | 9/1986 | Fukita | 123/90.31 |
| 4,617,882 A | | 10/1986 | Matsumoto | 123/90.31 |
| 4,915,066 A | | 4/1990 | Koshimoto et al. | 123/90.27 |
| 5,097,805 A | | 3/1992 | Uesigl et al. | 123/90.34 |
| 5,351,663 A | * | 10/1994 | Makimura et al. | 123/90.27 |
| 5,417,186 A | | 5/1995 | Elrod et al. | 123/90.17 |
| 5,564,380 A | * | 10/1996 | Kobayashi et al. | 123/192.2 |
| 5,735,239 A | | 4/1998 | Sugano et al. | 123/90.31 |
| 6,244,230 B1 | * | 6/2001 | Mikame | 123/90.17 |
| 2001/0025612 A1 | | 10/2001 | Okul et al. | 123/90.15 |
| 2001/0042527 A1 | | 11/2001 | Uchida | 123/90.15 |

FOREIGN PATENT DOCUMENTS

| | | |
|---|---|---|
| DE | 100 01 066 | 3/2001 |
| DE | 100 42 014 | 3/2002 |
| EP | 0 624 717 | 11/1994 |

* cited by examiner

*Primary Examiner*—Thomas Denion
*Assistant Examiner*—Kyle M. Riddle
(74) *Attorney, Agent, or Firm*—Gudrun E. Huckett

(57) ABSTRACT

A camshaft adjusting device for internal combustion engines of motor vehicles has an intake camshaft adjuster and an exhaust camshaft adjuster driven by an endless drive connected to the crankshaft. The intake and exhaust camshaft adjusters are connected by a gear transmission to one another. The intake and exhaust camshaft adjusters each have a gear forming a part of the gear transmission. The intake and exhaust camshaft adjusters are directly drivingly connected by the gears or a common gear wheel fixedly connected to an intermediate shaft is positioned between the gears.

13 Claims, 4 Drawing Sheets

CAMSHAFT ADJUSTING DEVICE FOR INTERNAL COMBUSTION ENGINES OF MOTOR VEHICLES

BACKGROUND OF INVENTION

1. Field of the Invention

The invention relates to a camshaft adjusting device for internal combustion engines of motor vehicles, comprising an intake camshaft adjuster and/or an exhaust camshaft adjuster drivingly connected to a crankshaft that drives by means of an endless drive the camshaft adjusting device.

2. Description of the Related Art

Camshaft adjusting devices are provided in order to control in internal combustion engines of motor vehicles the opening time of the intake valves as a function of the momentary power demand of the internal combustion engine. For this purpose, an intake camshaft adjuster 1 (FIG. 2) and/or an exhaust camshaft adjuster 2 are provided that are drivingly connected by means of an endless circulating chain 5 to a crankshaft 3. The camshaft adjusters 1, 2 each comprise a stator in which a rotor, fixedly mounted on the camshaft 12, 29, respectively, is arranged rotatably relative to the stator. The rotors are loaded by a pressure medium when they are to be rotated relative to the stator. The stators of the two camshaft adjusters 1, 2 each are provided with a drive wheel 6, 6' across which the chain 5 is guided. In the case of cramped or tight mounting space, it is difficult and sometimes not possible to mount the chain 5.

SUMMARY OF INVENTION

It is an object of the present invention to configure the camshaft adjusting device of the aforementioned kind such that it can be simply mounted even in the case of cramped mounting conditions.

In accordance with the present invention, this is achieved in that the two camshaft adjusters engage one another by means of a gear transmission.

In the camshaft adjusting device of the present invention the two camshaft adjusters are drivingly connected to one another by means of a gear transmission. The drive wheel of the first camshaft adjuster can be mounted easily in a precise position wherein, even in the case of cramped mounting conditions, the endless circulating drive element can be mounted easily.

The two camshaft adjusters each have a stator surrounding a rotor that is rotatable relative to the stator and is fixedly mounted on its camshaft, respectively. The rotors of the camshaft adjusters can be adjusted by pressure medium in the desired direction relative to the stator in order to change in this way the opening time of the intake valves of the internal combustion engine.

In a first embodiment of the invention, the camshaft adjusters directly engage one another by means of their gears. In this case, the crankshaft is connected by means of the endless drive only to the first camshaft adjuster.

In a second configuration, the gears of the two camshaft adjusters engage a common gear wheel which is mounted fixedly on an intermediate shaft. The intermediate shaft is drivingly connected by means of the endless drive to the crankshaft. In this case, the intermediate shaft is rotatably driven by means of the endless drive so that the camshaft adjusters are driven via the gear transmission.

DETAILED DESCRIPTION

Figure 3:
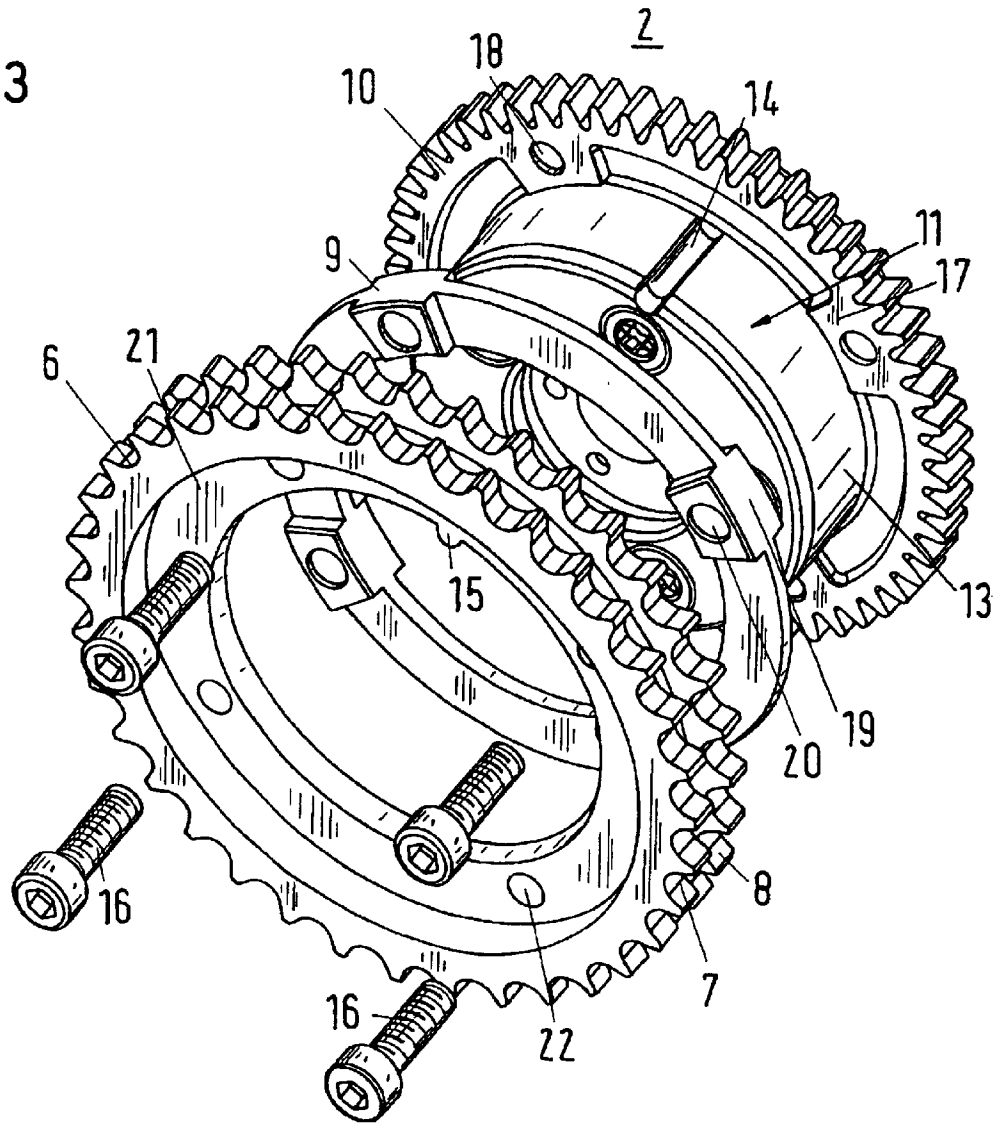
FIG. 3 is an exploded view of the camshaft adjusting device according to the present invention.
Figure 5:
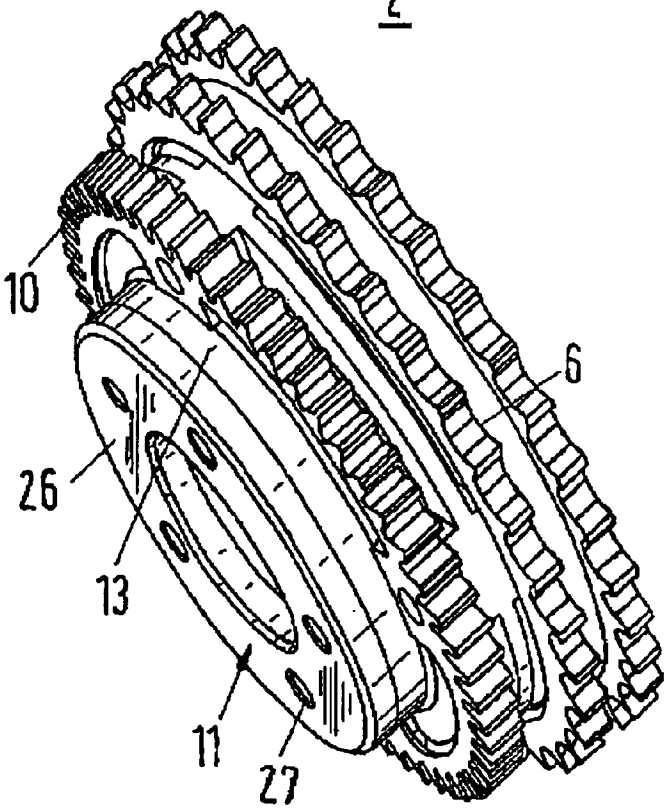
FIG. 5 is a perspective illustration of a front view of the camshaft adjusting device according to the invention.
Figure 4:
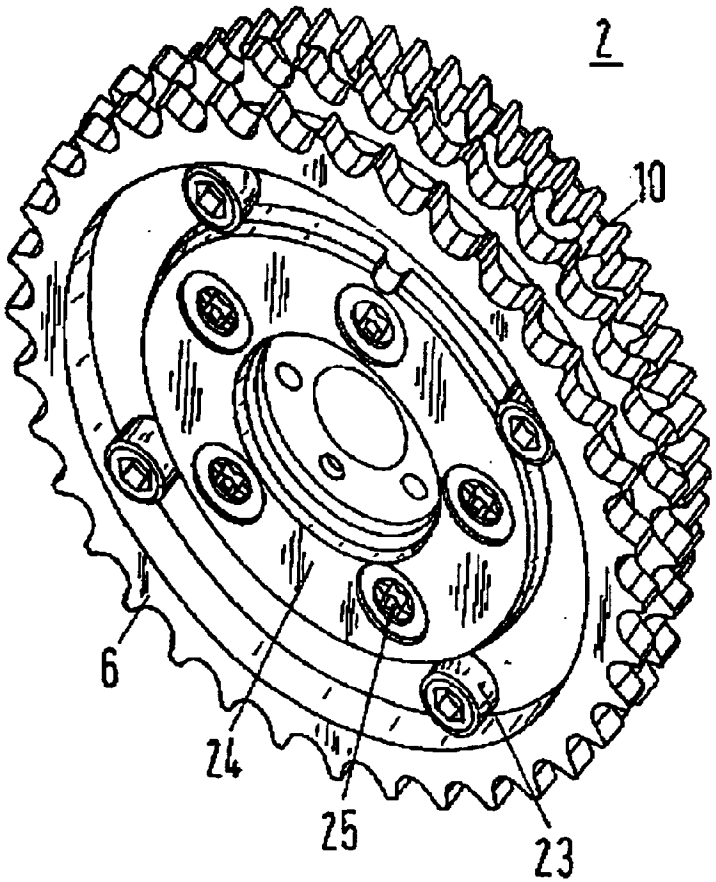
FIG. 4 is a perspective illustration showing a rearview of the camshaft adjusting device according to the invention.

The camshaft adjusting device according to FIGS. 1 and 3 to 5 comprises an intake camshaft adjuster 1 and an exhaust camshaft adjuster 2. On the crankshaft 3, a chain wheel 4 is fixedly mounted which is drivingly connected by chain 5 to the chain wheel 6 of the exhaust camshaft adjuster 2. The chain wheel 6 can be a single track wheel or double track wheel. As illustrated in FIGS. 3 to 5, the chain wheel 6 in the illustrated embodiment is of a double track configuration and has accordingly two gear rings 7 and 8. The chain wheel 6 is connected by means of a spacer member 9 to a gear in the form of a gear ring 10 that is advantageously a monolithic part of the stator 11. The stator 11 surrounds, as is known in the art, the rotor that is fixedly mounted on the exhaust camshaft 12. As illustrated in FIG. 3, the stator 11 has a cylindrical wall 13 projecting past the gear ring 10 in the axial direction and comprising at least one positive-locking element in the form of a recess 14 extending the axial direction. In the illustrated embodiment, the recess 14 has a part-circular cross-section. A matching counter locking element in the from of a projection 15 engages this recess 14 in a positive-locking way. This projection 15 is provided on the inner side of the chain wheel 6. By means of the recess 14 and the projection 15, a radial alignment of the chain wheel 6 relative to the stator 11 that is part of the camshaft adjuster 2 is realized. The spacer member 9 and the chain wheel 6 are pushed onto the peripheral wall 13. Subsequently, the spacer member 9 and the chain wheel 6 are connected by screws 16 to the stator 11 and the gear ring 10.

The gear ring 10 has a greater inner diameter than the peripheral wall 13 of the stator 11. Webs 17 that are uniformly distributed about the circumference project from the inner side of the gear ring 10. The webs 17 connect the gear ring 10 to the stator wall 13. The webs 17 have threaded bores 18 into which the screws 16 can be screwed.

The spacer member 9 has widened portions 19 distributed circumferentially about the member 9 and projecting past both end faces of the spacer member 9. The widened portions 19 each have an opening 20 for passing the screws 16 therethrough.

The chain wheel 6 has an inner circumferentially extending flange 21 that is located at approximately half the width of the chain wheel 6 and is provided with openings 22 distributed about the circumference for passing the screws 16 therethrough. Since the flange 21 is recessed relative to the end faces of the chain wheel 6, the heads 23 of the screws 16 are recessed within the chain wheel 6 (FIG. 4). The spacer member 9 positions the chain wheel 6 at an axial spacing relative to the gear ring 10.

On the end face of the stator wall 13 facing the chain wheel 6 a cover plate 24 (FIG. 4) is fastened by means of screws 25. As is known in the art, the cover plate 24 secures axially the rotor that is fixedly fastened on the camshaft 12

Figure 1:
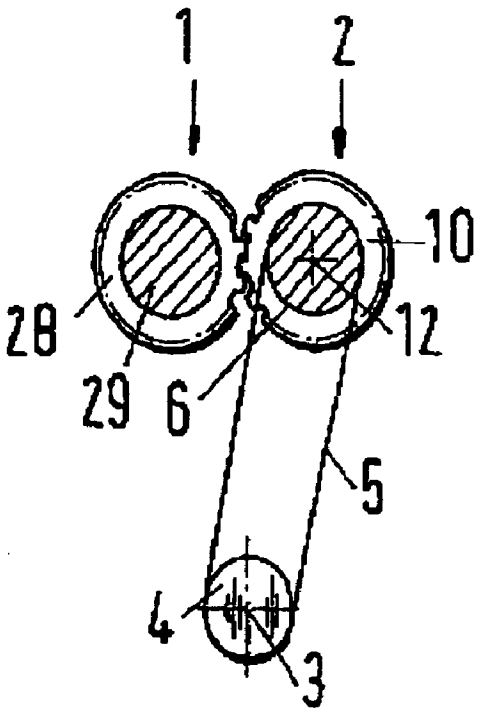
FIG. 1 shows a first embodiment of a camshaft adjusting device with camshaft adjusters according to the invention.
Figure 2:
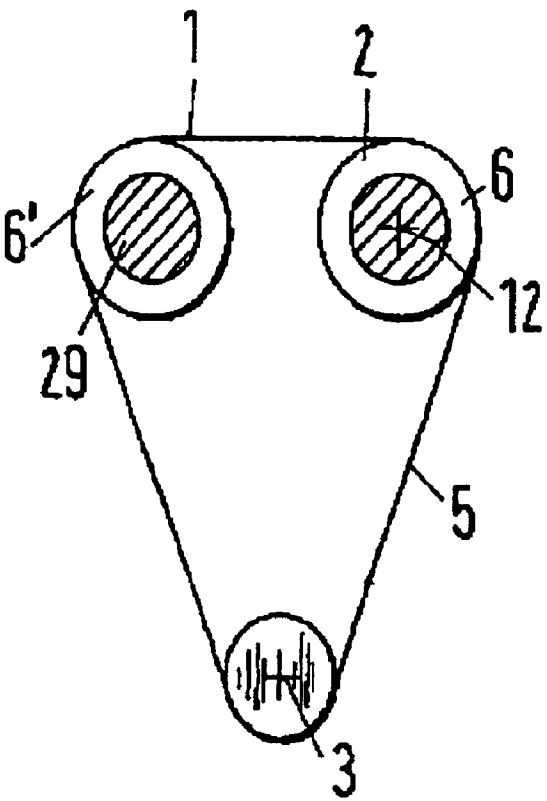
Fig.2 PRIOR ART
FIG. 2 shows a camshaft adjusting device according to the prior art.

(FIG. 1). On the opposite end face of the wall 13 of the stator 11 an annular disk 26 is secured by screws 27 that secures the rotor in the other axial direction on the stator 11.

The chain 5 of the camshaft adjusting device is guided about the chain wheel 6 (FIG. 1). The gear ring 10 engages a gear in the form of a gear ring 28 of the intake camshaft adjuster 1 (FIG. 1) that is fixedly connected to the stator 11; preferably, it is a monolithic part of the stator 11. Advantageously, the gear rings 10, 28 have the same diameter.

Since the intake camshaft adjuster 1 and the exhaust camshaft adjuster 2 directly engage one another by means of the gear rings 10, 28, the two camshafts 12, 29 can be arranged adjacent to one another at a minimal spacing. In this way, the camshaft adjusting device can be mounted easily even for cramped mounting conditions because the chain drive is provided only between the gear wheel 4 on the crankshaft 3 and the chain wheel 6 of the camshaft adjuster 2.

The chain wheel 6 can be fastened in the described way easily on the stator wall 13. The crankshaft 3 is connected by means of the chain 5 to the camshaft 12 which, in turn, is drivingly connected via the gear rings 10, 28 to the camshaft 29. The gear ring 10 and the chain wheel 6 can be manufactured of different materials so that an optimal material adjustment of these parts is possible with regard to the specific use of the adjusting device.

Figure 6:
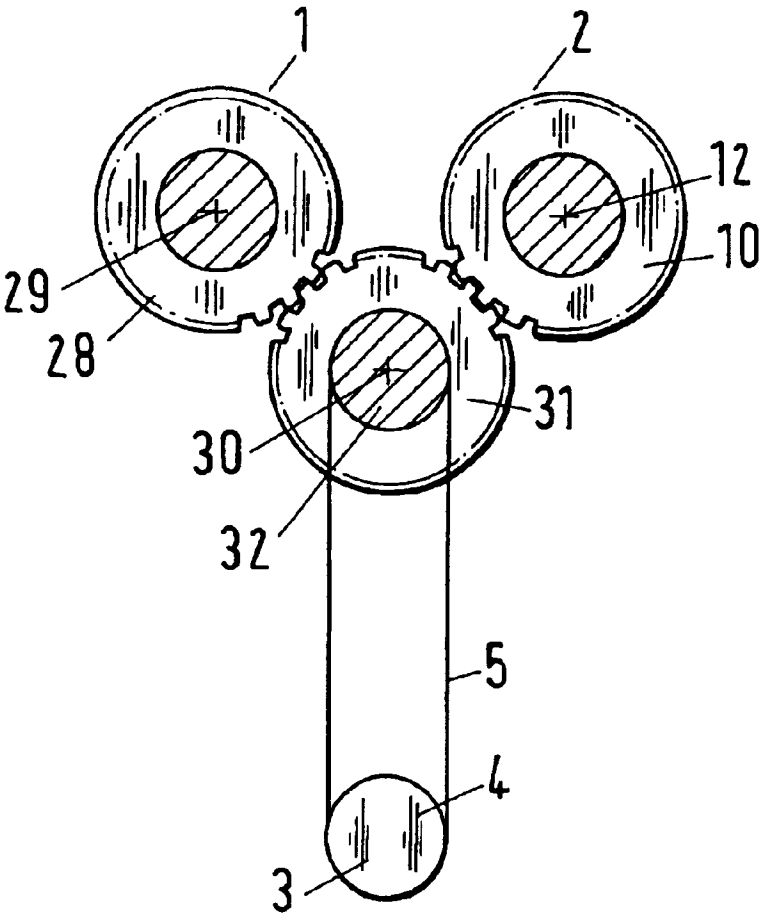
FIG. 6 is a schematic illustration of a second embodiment of a camshaft adjusting device according to the invention.

In the embodiment of FIG. 6, the intake camshaft adjuster 1 and the exhaust camshaft adjuster 2 are not directly engaging one another by means of the gear rings 10, 28. The camshaft adjusting device has an intermediate shaft 30 that is positioned parallel to the crankshaft 3 and the camshafts 12, 29 and supports a gear wheel 31 fixedly connected thereto. The gear wheel 31 engages the gear rings 10, 28 of the two camshaft adjusters 1, 2. There is also a chain wheel 32 mounted fixedly on the intermediate shaft 30 for receiving the chain 5. The crankshaft 3 drives thus by means of the chain drive 4, 5, 32 the intermediate shaft 30 that, in turn, drives via the gear wheel 31 the camshaft adjusters 1, 2 in the described way. The gear wheels 31 and gear rings 10, 28 have advantageously the same diameter. However, it is possible to provide the gear wheel 31 with a diameter that is different from that of the gear rings 10, 28 so that, depending on the diameter ratio, a reduction gearing or step-up gearing is enabled.

This embodiment is also characterized in that it can be mounted in a simple way even under cramped or tight mounting conditions. The chain drive is provided only between the gear wheel 4 of the crankshaft 3 and the gear wheel 31 of the intermediate shaft 30.

While specific embodiments of the invention have been shown and described in detail to illustrate the inventive principles, it will be understood that the invention may be embodied otherwise without departing from such principles.

What is claimed is:

1. A camshaft adjusting device for internal combustion engines of motor vehicles, the device comprising:

an intake camshaft adjuster and an exhaust camshaft adjuster driven by an endless drive connected to a crankshaft;

wherein the intake and exhaust camshaft adjusters are connected by a gear transmission to one another;

wherein a first one of the intake and exhaust camshaft adjusters comprises a drive wheel and a gear forming a part of the gear transmission, wherein the drive wheel and the gear are positioned axially adjacent to one another;

wherein the first one of the intake and exhaust camshaft adjusters further comprises a spacer member, wherein the spacer member separates the drive wheel and the gear from one another and wherein the spacer member is a force transmitting element transmitting a drive force from the drive wheel onto the gear.

2. The device according to claim 1, wherein the drive wheel is a chain wheel.

3. The device according to claim 1, wherein the drive wheel belongs to the exhaust camshaft adjuster.

4. The device according to claim 1, wherein the intake and exhaust camshaft adjusters each have a gear forming a part of the gear transmission.

5. The device according to claim 4, wherein the intake and exhaust camshaft adjusters are directly drivingly connected by the gears.

6. The device according to claim 5, wherein the gears have identical diameter.

7. The device according to claim 4, further comprising an intermediate shaft provided with a common gear wheel fixedly connected to the intermediate shaft, wherein the gears of the intake and exhaust camshaft adjusters engage the common gear wheel.

8. The device according to claim 7, wherein the intermediate shaft as drivingly connected to the endless drive.

9. A camshaft adjusting device for internal combustion engines of motor vehicles, the device comprising:

an intake camshaft adjuster and an exhaust camshaft adjuster driven by an endless drive connected to a crankshaft;

wherein the intake and exhaust camshaft adjusters are connected by a gear transmission to one another;

wherein a first one of the intake and exhaust camshaft adjusters comprises a drive wheel end a gear forming a part of the gear transmission, wherein the drive wheel and the gear are positioned axially adjacent to one another;

wherein the gear is a monolithic part of a stator of the first one of the intake and exhaust camshaft adjusters.

10. A camshaft adjusting device for internal combustion engines of motor vehicles, the device comprising:

an intake camshaft adjuster and an exhaust camshaft adjuster driven by an endless drive connected to a crankshaft;

wherein the intake and exhaust camshaft adjusters are connected by a gear transmission to one another;

wherein a first one of the intake and exhaust camshaft adjusters comprises a drive wheel and a gear forming a part of the gear transmission, wherein the drive wheel and the gear are positioned axially adjacent to one another;

wherein the drive wheel is fastened on the gear.

11. A camshaft adjusting device for internal combustion engines of motor vehicles, the device comprising:

an intake camshaft adjuster and an exhaust camshaft adjuster driven by an endless drive connected to a crankshaft;

wherein the intake and exhaust camshaft adjusters are connected by a gear transmission to one another;

wherein a first one of the intake and exhaust camshaft adjusters comprises a drive wheel and a gear forming a part of the gear transmission, wherein the drive wheel and the gear are positioned axially adjacent to one another;

wherein the drive wheel is provided with at least one positive-locking element and wherein the first one of the intake and exhaust camshaft adjusters has at least one counter locking element interacting with the at least one positive-locking element for radially aligning the drive wheel and the gear.

12. The device according to claim 11, wherein the positive-locking element is a radial projection on an inner side of the drive wheel.

13. The device according to claim 11, wherein the counter locking element is an axial groove in a wall of a stator of the first one of the intake and exhaust camshaft adjusters.

* * * * *